United States Patent [19]

Potucek

[11] Patent Number: 4,899,515

[45] **Date of Patent: * Feb. 13, 1990**

[54] CONCRETE REINFORCING BAR SUPPORT

[75] Inventor: Frank R. Potucek, Palmetto, Fla.

[73] Assignee: American Rebar, Inc., Midway, Ga.

[ * ] Notice: The portion of the term of this patent subsequent to Dec. 20, 2005 has been disclaimed.

[21] Appl. No.: 193,424

[22] Filed: May 12, 1988

Related U.S. Application Data

[63] Continuation-in-part of Ser. No. 45,097, May 1, 1987, Pat. No. 4,791,772.

[51] Int. Cl.[4] ..... E04C 5/03

[52] U.S. Cl. ..... 52/738; 52/737; 403/314

[58] Field of Search ..... 52/737–740; 403/314, 296

[56] References Cited

U.S. PATENT DOCUMENTS

| | | | |
|---|---|---|---|
| 815,618 | 3/1906 | Mueser | 52/738 |
| 863,959 | 8/1907 | Williamson | 52/737 |
| 1,317,824 | 10/1919 | Royse | 52/738 |
| 1,400,278 | 12/1921 | Fougner | 52/739 |
| 1,514,806 | 11/1924 | Thomas | 52/739 |
| 2,264,480 | 12/1941 | Owen | 403/296 |
| 3,378,985 | 4/1968 | Bugan | 52/739 |
| 3,771,884 | 11/1973 | Williams | 52/937 X |
| 4,179,583 | 12/1979 | Sergev | 403/314 X |

FOREIGN PATENT DOCUMENTS

| | | | |
|---|---|---|---|
| 636302 | 2/1962 | Canada | 52/738 |
| 626831 | 11/1961 | Italy | 52/737 |
| 353156 | 5/1961 | Switzerland | 52/738 |

*Primary Examiner*—Richard E. Chilcot, Jr.
*Attorney, Agent, or Firm*—Ronald E. Smith; Joseph C. Mason

[57] ABSTRACT

A horizontally extending reinforcing bar having a central core in transverse cross-section exhibiting at least three radial fins projecting outwardly symmetrically from the center of the bar to its outer edge. Each pair of adjacent fins define a valley between them containing a pattern of raised surface area. Two in-line reinforcing bars are held together by a coupling device having a housing with multiple flexible inwardly projecting plates from grooves in an inner wall. The plates flex in the direction of insertion of a reinforcing bar and exert a force to prevent removal of the bar.

22 Claims, 3 Drawing Sheets

CONCRETE REINFORCING BAR SUPPORT

CROSS REFERENCE TO RELATED APPLICATIONS

This disclosure is a continuation-in-part of my copending disclosure entitled "Concrete Reinforcing Bar Support" filed on May 1, 1987, bearing Ser. No. 07/045,097 now U.S. Pat. No. 4,791,772.

TECHNICAL FIELD This invention relates to reinforcing bars for strengthening concrete forms. More particularly, it refers to a star shaped reinforcing bar in transverse cross section having increased holding resistance in a concrete form.

BACKGROUND ART Reinforcing bars are customarily used to provide internal support for concrete forms. Over the years many variations in such reinforcing bars have been introduced as shown in the following patents:

| U.S. Pat. Nos. | |
|---|---|
| 4,229,501 | 3,415,552 |
| 4,119,764 | 3,335,539 |
| 3,561,185 | 3,312,035 |
| 1,007,107 | 2,062,383 |
| 3,260,150 | 3,280,874 |
| 3,292,337 | 3,302,348 |
| 3,347,005 | 3,348,354 |
| 3,376,686 | 3,401,497 |
| 3,430,406 | 3,641,799 |
| 3,641,799 | 3,782,839 |
| 3,948,010 | 3,950,905 |
| 3,952,468 | 3,986,311 |
| 3,986,311 | 4,018,055 |
| 4,137,685 | 4,137,685 |
| 4,137,686 | 4,165,904 |
| 4,185,440 | 4,192,114 |
| 4,308,705 | 4,320,544 |
| 4,406,103 | 4,507,817 |
| 4,507,817 | 4,601,625 |
| 4,620,401 | 815,618 |
| 863,959 | 1,317,824 |
| 1,400,278 | 1,514,806 |
| 2,264,480 | 3,378,985 |
| 3,771,884 | 4,179,583 |
| 3,979,186 | |
| 353,156 (Switzerland) | |
| 626,831 (Italy) | |
| 636,302 (Canada) | |

Reinforcing bars have been generally employed to furnish tensile strength to concrete sections subject to bending loads and additional compressive strength when unreinforced concrete would prove too bulky. The deformed reinforcing bars have been used specifically to inhibit longitudinal movement of the bars relative to the surrounding concrete. Although some effort in the prior art has been directed to improve the tensile strength of a given size reinforcing bar, there has not been any substantial effort to reduce the amount of metal required for a reinforcing bar while retaining the same tensile strength, bending load, compressive strength and inhibition against longitudinal movement in concrete.

DISCLOSURE OF INVENTION

I have invented a novel reinforcing bar structure that maintains all of the desired characteristics of a reinforcing bar such as tensile strength, bending load, compressive strength and inhibition against longitudinal movement in concrete, and in the same structure saves significant amounts of metal resulting in lower cost reinforcing bars.

My preferred reinforcing bar has a star shaped core in transverse cross-section. The star shape is expressed by five radial fins directed outwardly from the center of the bar. A valley between each fin contains a pattern of raised surface area. A coupling device having a cylindrical housing with an outer and inner wall is used to hold two in-line reinforcing bars together. The inner wall of the housing contains multiple flexible inwardly projecting plates that flex in a direction of reinforcing bar insertion and exert a force against the bar to prevent its removal.

In a first embodiment of the invention, the sidewalls that form the fins of the improved rebar are tapered, i.e., they converge toward one another from their radially innermost to their radially outermost ends. A star shaped cross section having a fin-included angle of about 98 degrees is disclosed.

In a second embodiment, the sidewalls that form the fins of the invention are parallel to one another, and a star shaped cross section having a fin-included angle of about 72 degrees is disclosed.

For rebars having a transverse section in the form of five pointed stars, it is believed that the disclosed minimum fin-included angle of 72 degrees and the maximum fin-included angle of 98 degrees are optimal. Angles less than 72 degrees provide scalloped fin sidewalls whereas angles greater than 98 degrees produce bulbous fin sidewalls.

Accordingly, any fin-included angle between 72 degrees and 98 degrees is within the scope of this invention.

The material saved in the smaller core embodiment (the 72 degree embodiment) is added to fins of the rebar so that they extend radially a greater extent than the fins of the 98 degree embodiment. Thus, the second embodiment provides a greater surface area to the concrete vis a vis that of the first embodiment.

Both embodiments use but 50 percent of the materials used by the rebars of the prior art yet provide a tensile strength of about 120,000–150,000 pounds per square inch.

It is therefore seen that the present invention is a pioneering invention in that it slashes half the weight from prior art rebars thereby providing a very lightweight and ductile rebar with a tensile strength even greater than that of the heavy rebars of the prior art.

An object of this important invention is to revolutionize the rebar manufacturing art by introducing rebars superior in all respects to conventional rebars in the all-important categories of materials used, weight, tensile strength, surface area and ductility.

The invention accordingly comprises the features of construction, combination of elements and arrangement of parts that will be exemplified in the construction hereinafter set forth and the scope of the invention will be indicated in the claims.

BRIEF DESCRIPTION OF DRAWINGS

For a fuller understanding of the nature and objects of the invention, reference should be made to the following detailed description, taken in connection with the accompanying drawings, in which.

Similar reference numerals refer to similar parts throughout the several views of the drawings.

BEST MODES FOR CARRYING OUT THE INVENTION

Figure 1:
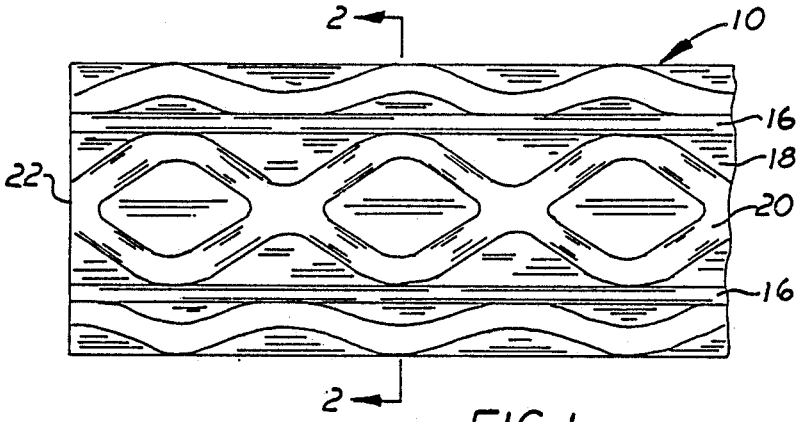
FIG. 1 is an elevation view of a cut off reinforcing bar of a first embodiment of the invention.

The preferred elongated concrete reinforcing bar 10 (hereinafter termed a rebar) has an elongated central core 12, five tapered radially protruding fins 14 from core 12 and an outer edge 16 on each fin 14. The rebar may have as few as three fins and as many as eleven fins symmetrically spaced apart.

Figure 2:
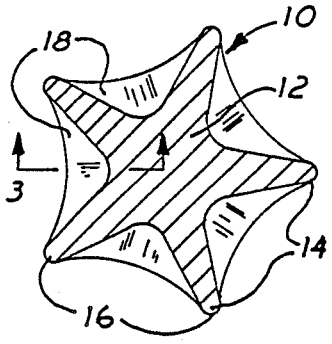
FIG. 2 is a transverse cross-sectional view of the preferred star shaped reinforcing bar shown in FIG. 1.

As shown in FIG. 2, a transverse cross-section of the rebar appears star-shaped since each of the fins 14 taper from the central core 12 outwardly to a rounded edge 16 at a point farthest from the central core 12.

The space between adjacent fins 14 forms a valley or cup 18 where a raised surface or web 20 is located.

Referring to FIG. 1, the rebar 10 is formed by a cold working technique generally described in my co-pending patent application bearing Ser. No. #07/109,988, filed Oct. 19, 1987. Conventional rebars are hot rolled and have a tensile strength of about 40,000–60,000 pounds per square inch. The novel rebars shown herein have a tensile strength of about 120,000–150,000 pounds per square inch.

Figure 4:
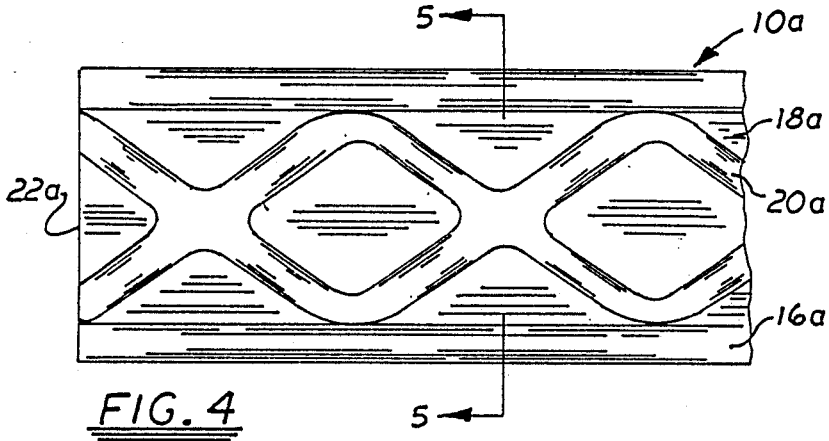
FIG. 4 is an elevation view of a cut off alternative reinforcing bar of the invention.
Figure 5:
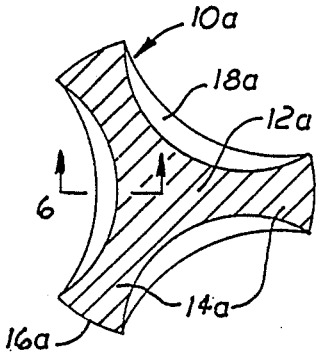
FIG. 5 is a transverse cross-sectional view of the three radial fin reinforcing bar shown in FIG. 4.
Figure 3:
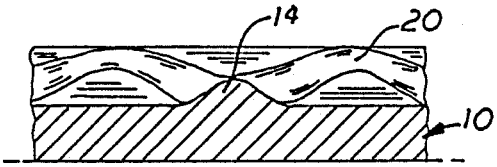
FIG. 3 is a sectional view along line 3—3 of FIG. 2.
Figure 6:
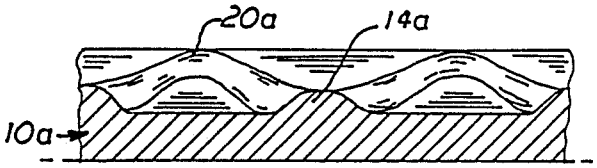
FIG. 6 is a sectional view along line 6—6 of FIG. 5.
Figure 7:
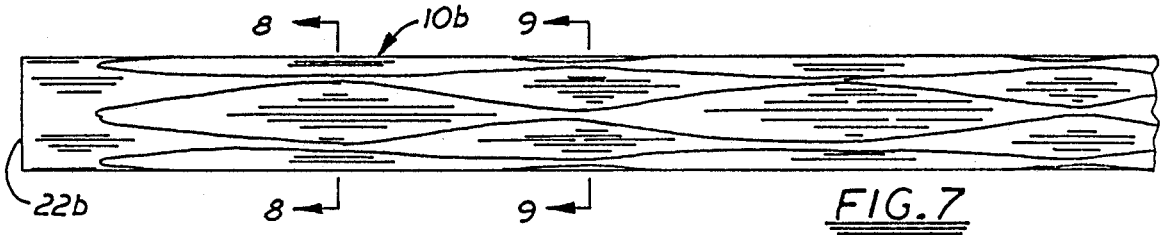
FIG. 7 is an elevation view of a cut off second alternative reinforcing bar of the invention.
Figure 8:
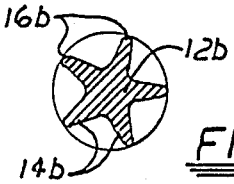
FIG. 8 is a transverse cross-sectional view along line 8—8 of FIG. 7.
Figure 9:
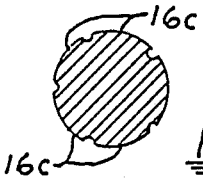
FIG. 9 is a transverse cross-sectional view along line 9—9 of FIG. 7.
Figure 13:
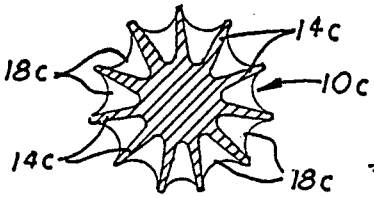
FIG. 13 is a transverse cross-sectional view of an eleven radial fin reinforcing bar.

Alternate designs for the rebar are shown in FIGS. 4, 7, and 13–16. In FIG. 4 rebar **10*a* has only three radial fins 14*a* which end at 16*a*. The cup 18*a* is more shallow than 18 because of a greater distance between fins 16*a*. The same pattern 20*a* is located in the cups 18*a*. In FIG. 7, a diamond shaped pattern is formed in rebar 10*b* so that alternate star shaped (FIG. 8) and notched circle (FIG. 9) configurations are exhibited in the same rebar. The outer edge 16*b* of the fins 14*b* are similar to the rebar of FIG. 1 and are clearly dissimilar in the section represented in FIG. 9. In FIG. 13, the rebar 10*c* has eleven fins 14*c* with cups 18*c*** between each pair of fins.

Figure 10:
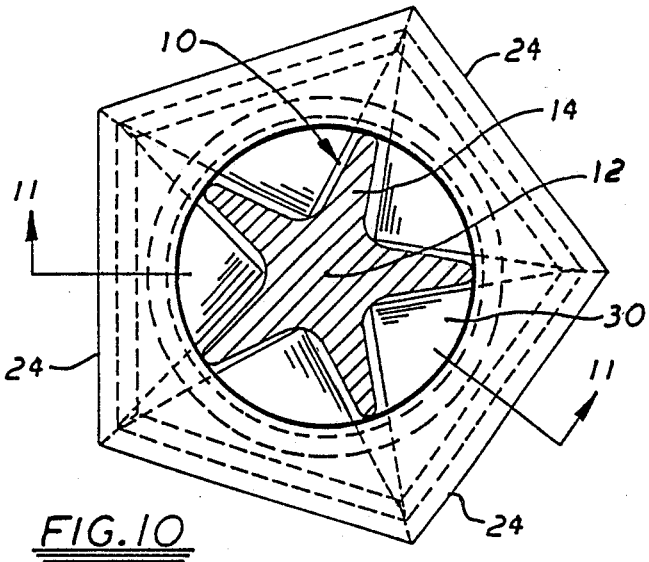
FIG. 10 is a plan view of the coupling device used to join two reinforcing bars together.
Figure 11:
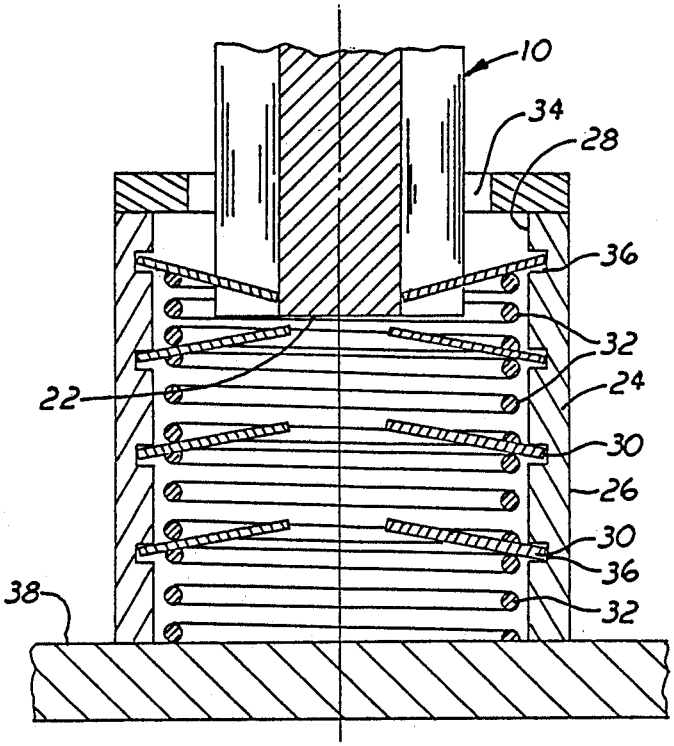
FIG. 11 is a sectional view along line 11—11 of FIG. 10.
Figure 12:
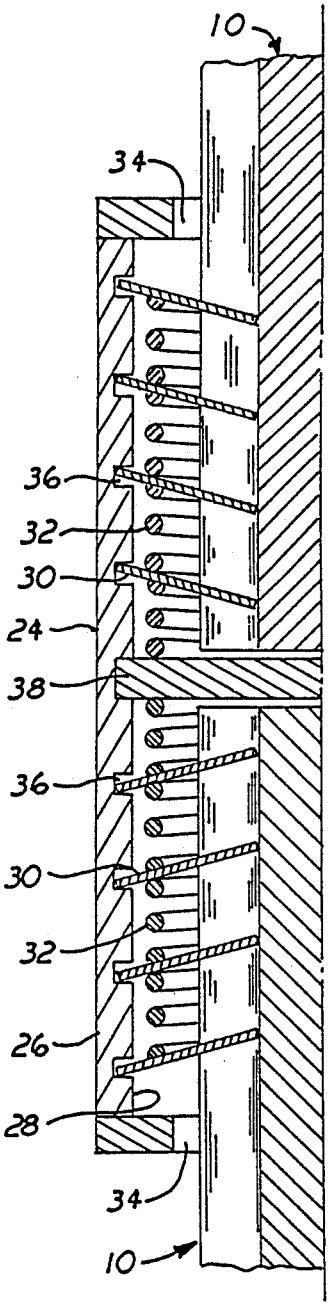
FIG. 12 is a sectional view showing two rebars in line held by the coupling device.

The end section 22 of rebar 10 or the corresponding sections of the other illustrated rebars can be joined end to end with another like rebar in an in-line configuration so that rebars can achieve almost continuous length depending upon the vertical height or lateral width of the structure to be supported. In FIG. 10 a coupling device 24 is shown with an inserted rebar 10 according to FIG. 1. The coupling device 24 is used either to hold the end of a rebar as in FIG. 11 or to join two rebars together as shown in FIG. 12.

The coupling device 24 has an outer wall 26 and an inner wall 28. Mounted within grooves 36 of the inner wall 28 are a series of flexible plates 30. The plates 30 flex between springs 32 so that movement of the rebar 10 in a direction through the opening 34 of the coupling device 24 flex the plates 30 in a downward direction. The plates 30 hold the rebar in place by friction force and prevent its withdrawal.

A butt plate 38 prevents movement of rebar 10 beyond its desired position within coupling device 24.

The coupling device can have the same number of sides 24 as conform to the number of fins 14 on the rebar or can be cylindrical in shape to accommodate rebars of differing numbers of fins.

Figure 14:
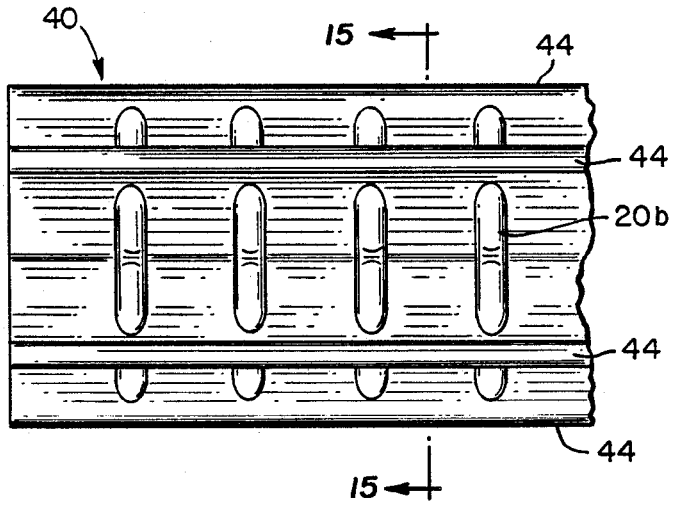
FIG. 14 is an elevation view of a cut-off reinforcing bar of a second embodiment of the invention.
Figure 15:
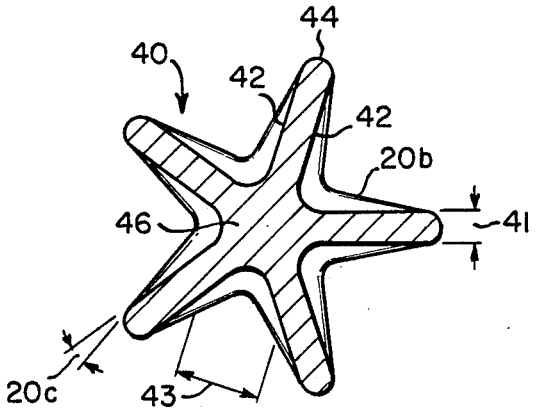
FIG. 15 is a transverse cross-sectional view taken along line 15—15 in FIG. 14.
Figure 16:
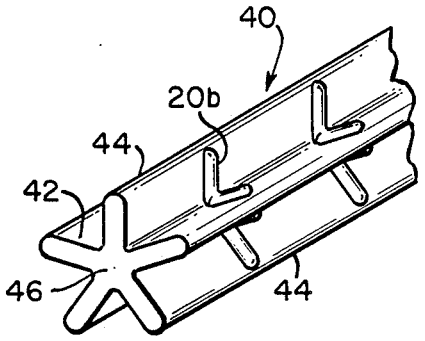
FIG. 16 a perspective view of the rebar of FIGS. 14 and 15.
Figure 17:
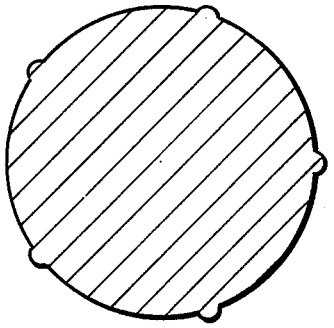
PRIOR ART FIG. 17
FIG. 17 is a cross-sectional view of a reinforcing bar of the prior art.

A rebar 40 that is believed to be the ultimate development in improved rebar construction is shown in FIGS. 14–16; a rebar of the type now in widespread use is depicted in section in FIG. 17 for comparison purposes.

Unlike the novel star-shaped rebar shown in section in FIG. 2, the rebar of the present embodiment has fin-forming sidewalls 42 that are parallel to one another, i.e., the fins of this embodiment are not tapered. Sidewalls 42 converge at rounded edges 44, as in the embodiment of FIG. 2.

The angle between the fins (the fin-included angle) in FIGS. 14–16 is about 72 degrees whereas the fin-included angle in FIG. 2 is about 98 degrees. Moreover, the diameter of the central core 46 of the FIG. 15 rebar is less than the core diameter of the FIG. 2 rebar. The width 41 of each fin is about one-half the diameter 43 of core 46.

Importantly, the materials saved by reducing the core diameter of the tapered fin star (FIG. 2) is added to the fins depicted in FIGS. 14–16 so that each fin has a greater radial extent. More specifically, an imaginary circle coincident with the radially outermost edges of the fins of the FIG. 2 embodiment has a diameter about three times greater than the diameter of the central core 12, whereas such an imaginary circle in FIG. 15 has a diameter about four times greater than the diameter of the central core shown in FIG. 15.

This configuration provides an increased surface area to which concrete may adhere. Specifically, the tapered fin rebar has a surface area about 17% greater than that of a comparable conventional round section rebar (FIG. 17). The non-tapered fin rebar provides a surface area 86% greater than that of a comparable conventional rebar, yet both embodiments use but half the materials as a conventional rebar, i.e., the cross-sectional area of both embodiments is about half that of a conventional rebar.

Those knowledgeable in the geometry of star-shaped patterns will appreciate that the fin-included angle of the FIG. 2 rebar (which angle is about 98 degrees) represents a maximum fin-included angle in that greater angles will produce bulbous or convex fins. Similarly, the fin-included angle of the FIG. 15 rebar represents a minimum angle in that sidewalls 42 will assume a scalloped or concave form if the angle is reduced below 72 degrees.

Accordingly, the present invention covers the two extreme limits of fin-included angles for five pointed star rebars and all angles therebetween.

Smaller core diameters result as the fin-included angle drops in increments from 98 degrees to 72 degrees, the taper of sidewalls 42 becomes less and less until the sidewalls are parallel to one another, and the materials saved by the smaller core is added to the fins to increase the radial extent as aforesaid.

Both the first-described embodiment and the present embodiment have a cross-sectional area only half that of round section rebars as indicated by a comparison of FIGS. 2, 15 and 17. This slashing of the amount of materials required to make a rebar is accomplished without an appreciable loss in ductility, and is accompanied by a dramatic increase in tensile strength and surface area.

Clearly, this invention discloses an important breakthrough in the art of rebar construction and the claims which conclude this disclosure are entitled, as a matter of law, to broad interpretation so as to protect the heart of this major invention.

The cost saving associated with the present invention provide ample evidence of the revolutionary nature of this invention. Steel companies currently produce millions of tons of rebars annually and consume vast amounts of raw materials. The present invention slashes in half the amount of materials needed to produce rebars as aforesaid. This slashes in half the weight of the rebars.

However, the novel material-saving, lightweight rebars of the present invention actually have a much greater tensile strength and surface area than conventional rebars, while having a comparable ductility. This achievement is quite significant.

The novel rebars are made by a cold-working process, as aforesaid. Accordingly, the tensile strength may be increased even further by aging the bars for one year or by baking them at 300 degrees F. for about ten minutes.

Conventional rebars have a microfinish of about 8–30 units (a microfinish unit indicates relative smoothness, with low numbers indicating relatively smooth surfaces such as the surfaces of conventional rebars and higher numbers indicating rougher surfaces such as sandpaper surfaces).

The present invention provides rebars having a microfinish of about 30–120 units. The rebar-contacting edges of the cold working rollers shown in the above-identified cold working technique patent are roughened by acid washing, sandblasting, peening or machining and the roughened edges emboss the rebars during the cold working process to provide still further anti-longitudinal slip means. Longitudinal slip of rebars is a major problem in the concrete construction industry and the present disclosure is believed to be the first disclosure anywhere of rebars having a rough microfinish.

The concave bights which are shown in FIGS. 2, 15 and 16 where the respective fins join the respective central cores are also worthy of note.

The reduced cross sections of the novel rebars have still another advantage as well. Steel and concrete have different expansion/contraction ratios when heated and cooled, respectively. As a result, concrete reinforced with conventional rebars of round cross section (FIG. 17) will crack during periods of rapid temperature change because the expansion or contraction of the two dissimilar materials is different as aforesaid. The smaller cross sections of the present invention, being 50% less than that of conventional rebars, together with the heat-radiating form of the fins, makes the rate of expansion and contraction of the novel rebars more similar to the expansion and contraction rate of the concrete within which it is embedded, thereby greatly reducing cracking.

Concrete and aluminum weigh about 0.10 pounds per cubic inch, whereas steel weighs about 0.30 pounds per cubic inch. The novel rebars weigh about 0.15 pounds per cubic inch, thereby rivaling concrete and aluminum in weight. The breakthrough in construction technology achieved by this invention is evident.

FIGS. 14–16 also show raised surfaces or webs **20*b* of unique design. Each web member 20*b* includes a pair of diverging radial arms integral to their respective underlying fin sidewall 42; the arms converge at a concave bight. Angle 20*c* is about 12°. Webs 20*b* can also be applied to the earlier-described rebars in lieu of webs 20 and 20*a*. A skip-rolling technique described in the above referenced patent provides the novel web member 20*b***. The purpose of the web members is to inhibit longitudinal slip.

A commercial embodiment of the present invention contemplates fin-included angles of about 85°; accordingly, the commercial rebar has an overall diameter about three and one-half times the diameter of its central core.

INDUSTRIAL APPLICABILITY

Millions of tons of rebars are used annually in virtually every country in the world. Most of the rebars in use have round cross sections and are therefore heavy and waste valuable raw materials. Use of the rebars disclosed herein by the concrete construction industry will save materials and reduce shipping costs, while providing a rebar of superior strength.

It will thus be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall there between.

Now that the invention has been described, what is claimed is:

1. An elongate concrete reinforcing bar or rebar having a transverse cross section in the form of a five pointed star and wherein five fins extend radially from a central core of said rebar at equidistantly and circumferentially spaced intervals to define a common fin-included angle between each contiguous pair of fins, wherein a diameter of an imaginary circle coincident with the radially outermost edges of said fins is about three times greater than a diameter of said central core, wherein an elongate cup-shaped bight is formed along the extent of said rebar where contiguous fins join said central core, and wherein a plurality of longitudinally extending raised surface areas having concave bights are formed along the extent of said elongate cup-shaped bight.

2. The rebar of claim 1 wherein said common fin-included angle is about 98 degrees.

3. The rebar of claim 2, wherein each of said fins is tapered.

4. The rebar of claim 1, wherein the surface area of said rebar is about 17% greater than the surface area of a rebar of comparable size having a round cross-section.

5. The rebar of claim 1, wherein said rebar is cold-rolled and has a tensile strength of about 120,000–150,000 pounds per square inch.

6. The rebar of claim 1, wherein the weight and quantity of material used to form said rebar is about ½ the weight and quantity of material used to form a comparable size rebar having a round cross section.

7. The rebar of claim 1, wherein the surface of said rebar has a roughness of about 30–120 microfinish units to further enhance its stability against longitudinal slippage in concrete.

8. The rebar of claim 1, wherein said rebar is joined to a second like rebar by a coupling device having a housing with an outer and inner wall, multiple flexible inwardly projecting plates mounted in a groove within the housing inner wall, whereby the plates flex in a direction of insertion of each reinforcing bar and exert a force against the bar to prevent its removal.

9. An elongate concrete reinforcing bar or rebar having a transverse cross section in the form of a five pointed star and wherein five fins extend radially from a central core of said rebar at equidistantly and circumferentially spaced intervals to define a common fin-included angle between each contiguous pair of fins, wherein a diameter of an imaginary circle coincident with the radially outermost edges of said fins is about four times greater than a diameter of said central core, wherein an elongate concave bight is formed along the extent of said rebar where contiguous fins join said central core, and wherein a plurality of longitudinally spaced, transversely disposed web means having concave bights are formed at preselected intervals along the extent of said elongate concave bight.

10. The rebar of claim 9, wherein said common fin-included angle is about 72 degrees.

11. The rebar of claim 9, wherein each of said fins has a uniform width.

12. The rebar of claim 11, wherein the width of said fins is about twice the diameter of said central core.

13. The rebar of claim 9, wherein the surface area of said rebar is about 86% greater than the surface area of a rebar of comparable size having a round cross section.

14. The rebar of claim 9, wherein said rebar is cold-rolled and has a tensile strength of about 120,000–150,000 pounds per square inch.

15. The rebar of claim 9, wherein the weight and quantity of material used to form said rebar is about one-half the weight and quantity of material used to form a comparable size rebar having a round cross section.

16. The rebar of claim 9, wherein the surface of said rebar has a roughness of about 30–120 microfinish units to further enhance its stability against longitudinal slippage in concrete.

17. The rebar of claim 9, wherein said rebar is joined to a second like rebar by a coupling device having a housing with an outer and inner wall, multiple flexible inwardly projecting plates mounted in a groove within the housing inner wall, whereby the plates flex in a direction of insertion of each reinforcing bar and exert a force against the bar to prevent its removal.

18. An elongate concrete reinforcing bar or rebar having a cross section in the form of at least a three pointed star and wherein fins extend radially from a central core of said rebar at equidistantly and circumferentially spaced intervals to define a common fin-included angle between each contiguous pair of fins, wherein an imaginary circle coincident with the radially outermost edges of said fins has a diameter between three to four times greater than the diameter of said central core, wherein an elongate concave bight is formed along the extent of said rebar where contiguous fins join said central core, and wherein a plurality of longitudinally spaced, transversely disposed web means having concave bights are formed at preselected intervals along the extent of said elongate concave bight.

19. The rebar of claim 18, wherein the number of fins is five and wherein the fin-included angle is between 72 degrees–98 degrees.

20. The rebar of claim 18, wherein said rebar is cold-rolled and has a tensile strength of about 120,000–150,000 pounds per square inch.

21. The rebar of claim 18, wherein the surface of said rebar has a roughness of about 30–120 microfinish units to further enhance its stability against longitudinal slippage in concrete.

22. The rebar of claim 18, wherein said rebar is joined to a second like rebar by a coupling device having a housing with an outer and inner wall, multiple flexible inwardly projecting plates mounted in a groove within the housing inner wall, whereby the plates flex in a direction of insertion of each reinforcing bar and exert a force against the bar to prevent its removal.

* * * * *